United States Patent [19]

O'Neal, Jr.

[11] 3,985,503

[45] Oct. 12, 1976

[54] PROCESS FOR INHIBITING METAL CORROSION

[75] Inventor: Cleveland O'Neal, Jr., Toledo, Ohio

[73] Assignee: The Sherwin-Williams Company, Cleveland, Ohio

[22] Filed: Mar. 17, 1975

[21] Appl. No.: 558,766

[52] U.S. Cl. ..... 21/2.7 R; 106/14; 252/180; 252/392; 252/394

[51] Int. Cl.[2] ..... C23F 11/12; C23F 11/14

[58] Field of Search ..... 106/14; 260/308 B; 252/392, 394, 77, 79, 180; 21/2.7 R

[56] References Cited

UNITED STATES PATENTS

| | | | |
|---|---|---|---|
| 3,425,954 | 2/1969 | Ruzevick et al. | 252/392 |
| 3,849,433 | 11/1974 | Butula | 252/392 |
| 3,895,170 | 7/1975 | Tanaka et al. | 106/14 |

*Primary Examiner*—Lorenzo B. Hayes

*Attorney, Agent, or Firm*—James V. Tura; Richard G. Smith; Neil A. DuChez

[57] ABSTRACT

This invention is directed to the use of substituted benzotriazoles and more specifically the carboxylated benzotriazoles including the alkali metal salts and alkyl esters thereof as inhibitors for metal in various corrosive organic liquids and aqueous mediums.

15 Claims, No Drawings

PROCESS FOR INHIBITING METAL CORROSION

This invention is directed to a process of inhibiting the corrosion of metals in contact with various corrosive organic liquids and aqueous systems and more particularly relates to a process of protecting metals in the presence of corrosive organic liquids and aqueous systems by adding to said organic liquids or water systems an effective amount of at least one substituted benzotriazole, i.e. the carboxylated benzotriazoles, including the metal salts and alkyl esters of said carboxylated benzotriazoles.

BACKGROUND

The use of triazoles and particularly benzotriazole as an anti-corrosive or anti-tarnishing agent in various mediums, e.g. aqueous and organic mediums is well known. It has been found, however, that effective amounts of the carboxylated benzotriazoles including the alkali metal salts and aliphatic esters thereof have improved corrosion inhibiting characteristics and are superior to many of the other triazoles. Generally, this would not be expected since the introduction of a substituent (—COOH) to the benzene ring of benzotriazole increases its molecular weight and thereby lowers the relative proporton of the corrosion-inhibiting center, i.e. the triazole ring of the molecule. This would be expected to reduce the effectiveness of the corrosion-inhibiting properties of the molecule. To the contrary, it has been found that the carboxyl substituent on the benzene ring of the benzotriazole even though increasing the molecular weight of the compound improves its corrosion inhibition characteristics and in many instances is superior to the triazoles presently being used in aqueous and organic systems.

In general, corrosion is defined as a destructive attack on metal involving an electrochemical or chemical reaction of the metal with its environment. Specifically, an electrochemical attack on metal surfaces is the wearing away and under-cutting of the metal which is accelerated after the protective coating, e.g. the oxide film is removed by the corrosive medium, e.g. organic or aqueous mediums. In addition to electrochemical attack, other types of corrosion include cavitation and erosion where in addition to electrochemical reactions the conditions of the aqueous system are such that the continuous flow causes cavities where high pressure areas develop causing pressure shock resulting in a pitted metal surface. This type of corrosion generally is found in water pumps, propellers, turbine blades, etc. In addition, erosion of metal surfaces, generally occurs when the mediums, e.g. the aqueous liquid contains suspended solids which impinge the surface of the metal as the fluid is transported, e.g. through metal conduits or pipes, etc., removing the protective film causing exposure of the metal which is subject to further corrosion.

SUMMARY

To avoid these and related problems, it has been found that certain caboxylate benzotriazoles (BTCOOH) including the alkali metal salts and alkyl esters, thereof may be added in effective amounts e.g. as low as 0.01 part per million or lower to various corrosive organic liquids or aqueous systems to protect metal such as copper, brass, steel, aluminum, etc. The carboxyl benzotriazoles of this invention are particularly useful in various aqueous mediums used in water systems, e.g. air conditioning, steam generating plants, refrigeration systems, acid-pickling systems, heat-exchange systems, engine jackets and pipes, and the like. As a specific illustration, the aqueous systems to which the caboxylated benzotriazoles may be added include the circulating water systems, e.g. for heating and cooling wherein either fresh water, treated fresh water, brines, sea water or sewage including the industrial waste waters is circulated in systems having surfaces containing iron, copper, aluminum, zinc, etc. and the alloys of these metals, such as steel, brass and the like.

Accordingly, it is an object of this invention to provide a process for inhibiting the corrosion of various metals coming in contact with aqueous systems. It is another object of this invention to provide a process for inhibiting the corrosion of metals in contact with various corrosive organic liquids. It is another object of this invention to provide a process for inhibiting the corrosion of tarnish of metals by utilizing effective amounts of carboxylated benzotriazoles in aqueous systems containing water soluble or dispersible organic compounds. It is a further object of this invention to provide a process whereby carboxyl substituted benzotriazoles may be added to aqueous or organic liquid sytems either alone or in combination with other known inhibitors to prevent the corrosion of metal.

These and other objects of the invention will become apparent from a further and more detailed description of the invention as follows.

DETAILED DESCRIPTION

More specifically, this invention relates to a process for inhibiting the corrosion of metal in contact with various corrosive organic liquids and aqueous systems, e.g. aqueous systems containing water in amounts ranging up to about 100% by weight which comprises adding to the corrosive organic liquid or aqueous system a corrosion-inhibiting amount of at least one substituted benzotriazole having the formula:

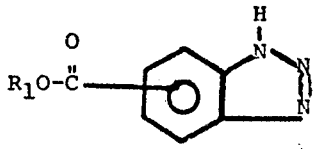

wherein $R_1$ is selected from the class consisting of hydrogen (i.e. BTCOOH), an alkali metal, e.g. sodium, potassium or lithium or any combination thereof (i.e. BTCOOM) and an aliphatic radical having from 1 to 12 carbon atoms (i.e. BTCOOR). The aliphatic radicals may be either saturated or unsaturated, i.e. the alkyl or alkenyl radicals, substituted or unsubstituted and particularly include the aliphatic radicals such as methyl, ethyl, propyl, isopropyl, butyl, isobutyl, pentyl, hexyl, heptyl, octyl, nonyl, decyl, undecyl and dodecyl.

While there are various methods of preparing the substituted benzotriazoles, for purposes of this invention, the carboxylated benzotriazole was prepared by the oxidation of 4-methyl-benzotriazole with potassium permaganate to obtain a substantially pure 4-carboxybenzotriazle.

The esters and metal salts of the carboxylated benzotriazole can be prepaed by conventional methods, e.g. by the reaction of an aliphatic alcohol or alkali metal compound with the carboxyl group of the BT. For example, the alkyl esters, e.g. methyl esters of a carboxylated benzotriazole (BTCOOR) may be prepared in accordance with the following procedure:

EXAMPLE 1

| Reactants | Parts by Weight |
|---|---|
| Carboxylated Benzotriazole | 16.3 |
| $SOCl_2$ | 24 |
| Methyl Alcohol | 100 ml |

The methyl alcohol and carboxylated benzotriazole (BTCOOH) were added to the reactor and the $SOCl_2$ was added dropwise while heating to the reflux temperature in about 2 hours. The reaction product was filtered, washed with water and dried at about 60° C. Chemical analysis confirmed that the methyl ester of the caboxylated benzotriazle was obtained.

The substituted benzotriazoles, e.g. carboxylated benzotriazole are added to the corrosive organic liquid or aqueous system in effective amounts ranging up to about 10,000 parts or more by weight of the substituted benzotriazole for every million part by weight of the corrosive organic liquid or aqueous system. The aqueous systems comprise water, e.g. water may be present in amounts ranging up to 100% of the system or in an amount of less than about 1% and the combination of water with other water dispersible or soluble organic liquids e.g. alcohol in amounts ranging up to 99% by weight. These water soluble or dispersible organic liquids may be present in the aqueous systems in amounts ranging up to about 100% by weight and include water dispersible or soluble alcohols, such as methanol, propanol, butanol, etc. and particularly the glycols such as ethylene glycol, propylene glycol, etc. Other organic liquids which may be found in the aqueous system include the esters, ethers, e.g. glycol ethers etc. and various organic solvents such as benzene, toluene, xylene, the chlorinated hydrocarbons, e.g. trichloroethylene, etc.

While there is no maximum or upper limit as to the amount of substituted benzotriazole that may be added to the organic or aqueous systems in accordance with this invention, e.g. may range up to 3.0% by weight, from a practical view the maximum amount should be dictated by the cost of the compound and therefore generally ranges up to about 10,000 e.g. 0.01 to 5000 parts by weight of the substituted benzotriazole for every million parts by weight of the aqueous system or the organic liquid, e.g. organic solvents etc. Preferably, the substituted benzotriazole is added to the corrosive organic liquids or aqueous systems, which may also contain organic solvents, in amounts ranging from about 0.1 to 2000 or 1.0 to 500 parts by weight of the benzotriazole for every million parts by weight of the organic liquid or the aqueous system.

As indicated, the substituted benzotriazoles of this invention are particularly useful for the treatment of a variety of aqueous systems that is aqueous systems corrosive to metal surfaces. These systems may include, for example, water treating systems, cooling towers, water-circulating systems for heating or cooling, heat exchangers, including the pipes thereof, paticularly where the liquid attacks iron or its alloys, copper or its alloys, aluminum or its alloys, etc. The water, for example, not only includes fresh water, but also sea water, brines, sewage and particularly the industrial waste waters which are utilized, for example, in cooling water tables for rolling hot steel and the like.

In some instances, such as in the acid-treating baths various pH control agents may be added to the system to neutralize the acid picked up by the circulating water. Thus, the aqueous mediums treated with the substantial benzotriazole may have a pH ranging from the acid side of 3.0 to the alkaline side of approximately 9.0. In addition to the substituted benzotriazoles of this invention, other known organic or inorganic corrosion inhibitors that may be used in any proportion with the benzotriazoles include, for example, various inorganic inhibitors such as the chromates, nitrates, nitrites, phosphates and the organic inhibitors such as the organo phosphates and particularly some of the other triazoles, e.g. benzotriazole, imidazoles, oxazoles, thiazoles and combinations thereof.

In preparing the metal coupons for testing in the organic and aqueous mediums, the coupons or test panels (copper, brass, aluminum and steel) were degreased e.g. in tetrachloroethylene, rinsed in acetone and air dried.

The tests utilized in determining the corrosion inhibition of the carboxylated benzotriazole including the esters and salts thereof in accordance with this invention may be illustrated by a specific example wherein steel coupons (SAE 1020) having an area of about 4.0 square inches were degreased in tetrachloroethylene, thoroughly cleaned, rinsed in acetone, dried and weighed. After weighing, the coupons were placed in a testing apparatus and immersed in a simulated cooling water (SCW) for a period of 24 hours at a temperature of about 50° C. The cooling water which simulates actual cooling water used in various commercial apparatus, e.g. heat transfer systems etc. was prepared by adding the following chemicals to distilled water.

| Chemicals | Parts by Weight |
|---|---|
| $MgSo_4$ | 42.1 |
| $CaSo_4$ | 70.2 |
| $NaHCO_3$ | 68.5 |
| $CaCl_2$ | 26.4 |
| NaCl | 13.4 |

The pH of the aqueous systems may range from the acid side, e.g. pH 3 to alkaline side, e.g. pH 9, but for most tests the pH was held at 6.5 to 7.5. The water may be further characterized as being corrosive and having a hardness, e.g. in terms of calcium carbonate of about 110. The testing apparatus was continuously aerated and after about 24 hours the steel coupons were withdrawn from the test water, rinsed and dried. The corrosion on the test coupons was removed and the coupons were again rinsed, dried and weighed and the weight loss recorded. The percent Inhibition Efficiency (I.E.) recited herein was calculated by using the equation:

$$\% \text{ I. E.} = 1 - \frac{\text{wt. loss of inhibited coupon}}{\text{wt. loss of control coupon}} \times 100$$

For purposes of this invention, the term "BTCOOH" means a carboxylated benzotriazole. The term "BTCOOM", e.g. "BTCOONa" means an alkali metal salt of the carboxylated benzotriazole and the term "BTCOOR" means an aliphatic ester of a carboxylated benzotriazole, e.g. BTCOOMe which is the methyl ester. The term "substituted benzotriazoles" means a carboxylated benzotriazole (BTCOOH), including the alkai metal salts (BTCOOM), the alkyl esters (BTCOOR) and the isomers thereof. The term "BT" means benzotriazoles and the term "TT" means tolyltriazoles.

The data in Tables 1 and 2 illustrate the effectiveness of carboxylated benzotriazole and the methyl and butyl esters thereof in benzene and kerosene which contained approximately 5% by weight of acetic acid as the corrosive agent. The test was run with the steel coupons for 24 hours at 50° C and the weight loss values are the average of three coupons.

TABLE 1

STEEL IN BENZENE

| Additive | Concentration (ppm) | Weight Loss (mg) | % I. E. |
|---|---|---|---|
| Control | — | 116.95 | — |
| BT COOH | 50 | 3.48 | 97.0 |
| Methyl Ester | 200 | 2.81 | 97.6 |
| Butyl Ester | 50 | 77.95 | 33.3 |
| Butyl Ester | 100 | 83.99 | 28.2 |
| Butyl Ester | 200 | 17.46 | 85.1 |

TABLE 2

STEEL IN KEROSENE

| Additive | Concentration (ppm) | Weight Loss (mg) | % I. E. |
|---|---|---|---|
| Control | — | 5.15 | — |
| BT COOH | 100 | 1.62 | 68.5 |
| Methyl Ester | 100 | 1.90 | 63.1 |

TABLE 2-continued

STEEL IN KEROSENE

| Additive | Concentration (ppm) | Weight Loss (mg) | % I. E. |
|---|---|---|---|
| Butyl Ester | 100 | 2.05 | 60.2 |

It should be noted that the Inhibition Efficiency is materially improved when utilizing the carboxylated benzotriazole and the methyl ester thereof with respect to protecting steel.

TABLE 3

CORROSION OF STEEL IN ISOOCTANE

Inhibitor Con. = 100 ppm (100 mg/l)

| Inhibitor | Weight Loss (mg) | % I. E. |
|---|---|---|
| Control | 5.98 | — |
| BT COOH | 2.50 | 58 |
| Methyl Ester | 2.54 | 58 |
| Butyl Ester | 2.02 | 66 |
| Octyl Ester | 1.72 | 71 |

With respect to the corrosion inhibition of steel in aliphatic organic liquids such as isooctane, improved inhibition was obtained with the higher molecular weight esters of the carboxylated benzotriazole. Here again, acetic acid in a 5% by weight concentration was used as the corrosive agent in a static test run for 48 hours at temperatures of 50° C.

TABLE 4

CORROSION OF STEEL IN BENZENE

| CONC. (ppm) | BTCOOH Wt. Loss (mg) | BTCOOH % I. E. | BT Wt. Loss (mg) | BT % I. E. | TT Wt. Loss (mg) | TT % I. E. |
|---|---|---|---|---|---|---|
| 25 | | | 74.58 | 0 (b) | 83.14 | 0 (b) |
| 50 | 2.82 | 94 (a) | 24.94 | 39 (b) | 109.35 | 0 (b) |
| 100 | 3.84 | 91 (a) | 4.49 | 89 (b) | 62.49 | 0 (b) |
| 200 | 3.21 | 93 (a) | 4.04 | 93 (c) | 11.66 | 79 (c) |
| 400 | — | — | 3.51 | 94 (c) | 6.68 | 88 (c) |
| 800 | — | — | 2.40 | 96 (c) | 3.50 | 94 (c) |

(a) Control weight loss 44.22 mg
(b) Control weight loss 40.79 mg
(c) Control weight loss 55.22 mg

TABLE 5

CORROSION OF STEEL AND COPPER IN BENZENE

| CONC. (ppm) | STEEL BTCOOH Wt. Loss | STEEL BTCOOH % I. E. | STEEL BT Wt. Loss | STEEL BT % I. E. | COPPER BTCOOH Wt. Loss | COPPER BTCOOH % I. E. | COPPER BT Wt. Loss | COPPER BT % I. E. |
|---|---|---|---|---|---|---|---|---|
| Control | 53.84 | | 67.83 | | 14.53 | | 9.09 | |
| 10 | 13.45 | 75 | 75.29 | 0 | 2.73 | 81 | 6.01 | 34 |
| 25 | 4.18 | 92 | 78.41 | 0 | 1.51 | 89 | 0.23 | 97 |
| 50 | 1.86 | 97 | 12.38 | 81 | 0 | 100 | 0.08 | 99 |
| 100 | 1.48 | 97 | 3.49 | 94 | .07 | 100 | −.05 | 100 |

NOTES

Temperature: 50°C (122°F)
Time: 24 hours
Static Beaker Test
Corrosive Agent: 5% (wt.)
Acetic Acid
Replicates: 2

Again in Tables 4 and 5, in a static test, steel and cooper coupons were tested in benzene containing 5% by weight of acetic acid at a temperature of 50° C for 24 hours. The data indicates that particularly at lower concentrations the carboxylated benzotriazole improved the corrosion inhibition of the metal coupons in comparison to either benzotriazole or tolyltriazole, as shown by the Inhibition Efficiency.

TABLE 6

PER CENT INHIBITION EFFICIENCIES FOR BTCOOH AND ITS ESTERS IN S. C. W.

| | BTCOOH Concentration (ppm) | | | METHYL ESTER Concentration (ppm) | | BUTYL ESTER Concentration (ppm) | |
|---|---|---|---|---|---|---|---|
| METAL | 250 | 500 | 1000 | 400 | 800 | 200 | <400 |
| Aluminum | 46% | 80% | 84% | 81% | 81% | 94% | 95% |
| Steel | 0 | 91 | 98 | 38 | 57 | 77 | 48 |
| Copper | 48 | 80 | 79 | 89 | 88 | 75 | 66 |
| Brass | 84 | 90 | 89 | — | — | 93 | 90 |

TABLE 7

WEIGHT LOSS DATA AND % I.E. FOR THREE METALS IN AERATED S. C. W.

| BTCOOH Inhibitor (ppm) | ADMIRALTY BRASS Wt. Loss (mg) | % I.E. | ALUMINUM Wt. Loss (mg) | % I.E. | MILD STEEL Wt. Loss (mg) | % I.E. |
|---|---|---|---|---|---|---|
| 0 (Control) | 2.09 | — | 11.30 | — | 111.90 | — |
| 100 | .41 | 80 | 5.88 | 48 | 48.88 | 56 |
| 300 | .37 | 82 | 5.54 | 51 | 11.49 | 90 |
| 500 | .18 | 91 | 5.79 | 49 | 1.60 | 99 |

NOTES:
1. Controls were average of 9 coupons.
2. Inhibited samples = average of 3 coupons.

The data in the above tables show that carboxylated benzotriazole and the methyl and butyl esters thereof substantially improve corrosion inhibition of aluminum, steel, copper and brass when exposed to corrosive simulated cooling water for 24 hours and 50° C. The corrosion inhibition, e.g. in terms of the percent, I.E. improved as the concentration of the substituted benzotriazole increased. The improvement of corrosion inhibition with increased concentration of inhibitor is particularly noted with steel and admiralty brass as indicated in Table 7.

TABLE 8

% INHIBITION EFFICIENCIES FOR BTCOOH AND ITS ESTERS ON THREE METALS

| METAL | Butyl Ester | | Methyl Ester | | BTCOOH | | |
|---|---|---|---|---|---|---|---|
| CONC. (PPM) → | 200 | 300 | 300 | 400 | 100 | 300 | 500 |
| Brass | 83% | 81% | 60% | 94% | 80% | 82% | 91% |
| Aluminum | 73 | 80 | 59 | 67 | 48 | 51 | 49 |
| Steel | 45 | 90 | 61 | 60 | 56 | 90 | 99 |

TABLE 9

% I. E. 'S FOR BTCOOH AND BTCOONa

| Inhibitor Conc. (ppm) | Brass Acid | Brass Salt | Aluminum Acid | Aluminum Salt | Steel Acid | Steel Salt |
|---|---|---|---|---|---|---|
| 50 | —% | 92% | —% | 35% | —% | 50% |
| 100 | 80 | 88 | 48 | 37 | 56 | 62 |
| 300 | 82 | 95 | 51 | 32 | 90 | 98 |
| 500 | 91 | 90 | 49 | 46 | 99 | 98 |

The data in the above tables show the Inhibition Efficiency for carboxylated benzotriazole and the methyl and butyl esters thereof in aerated simulated cooling water. These experiments were run for 24 hours at 50° C and at a pH of about 7. It should be noted that the inhibition increased with the increase in concentration of the inhibitor as indicated in Table 8. In Table 9, the carboxylated benzotriazole and the sodium salt thereof show improved inhibition with respect to brass, aluminum and steel and show particular improvement with the increase in concentration. The tests were conducted in aerated simulated cooling water at a pH of about 7 for a period of about 24 hours at 50° C.

TABLE 10

% INHIBITION EFFICIENCY FOR ALUMINUM/BRASS IN AERATED S. C. W.

| Inhibitor (300 ppm) | pH 7.0 Aluminum | pH 7.0 Brass | pH 8.0 Aluminum | pH 8.0 Brass |
|---|---|---|---|---|
| BTCOOH | 57% | 81% | 0% | 45% |
| Butyl Ester | 92 | 82 | 77 | 61 |

TABLE II

% INHIBITION EFFICIENCY FOR ALUMINUM/STEEL IN AERATED S. C. W.

| Inhibitor (300 ppm) | pH 7.0 Aluminum | pH 7.0 Steel | ph 8.0 Aluminum | ph 8.0 Steel |
|---|---|---|---|---|
| BTCOOH | 56% | 85% | 0% | 96% |
| Butyl Ester | 90 | 93 | 73 | 55 |

The data in the above tables show the inhibition efficiency for aluminum/brass and aluminum/steel in aerated simulated cooling water at different pH levels.

TABLE 12

WEIGHT LOSS DATA AND % I. E. FOR FOUR METALS IN S. C. W.

| Additive | Conc. (ppm) | COPPER Wt. Loss (mg) | COPPER % I.E. | BRASS Wt. Loss (mg) | BRASS % I.E. | ALUMINUM Wt. Loss (mg) | ALUMINUM % I.E. | STEEL Wt. Loss (mg) | STEEL % I.E. |
|---|---|---|---|---|---|---|---|---|---|
| Blank | — | 1.88 | — | 3.04 | — | 21.00 | — | 53.58 | — |
| BTCOOH | 250 | .98 | 47.87 | .48 | 84.21 | 11.33 | 46.05 | 59.07 | — |
| BTCOOH | 500 | .37 | 80.32 | .32 | 89.47 | 4.37 | 79.48 | 4.98 | 90.71 |
| BTCOOH | 1000 | .40 | 78.72 | .33 | 89.14 | 3.43 | 83.67 | 1.11 | 97.93 |

TABLE 13

WEIGHT LOSS DATA AND % I. E. FOR THREE METALS IN S. C. W.

| Additive | Conc. (ppm) | COPPER Wt. Loss (mg) | COPPER % I.E. | ALUMINUM Wt. Loss (mg) | ALUMINUM % I.E. | STEEL Wt. Loss (mg) | STEEL % I.E. |
|---|---|---|---|---|---|---|---|
| Blank | — | 3.15 | — | 16.33 | — | 55.90 | — |
| BTCOOMe | 400 | .35 | 88.89 | 3.08 | 81.14 | 34.95 | 37.48 |
| BTCOOMe | 800 | .38 | 87.94 | 3.07 | 81.20 | 24.01 | 57.04 |

The data in the above tables show that carboxylated benzotriazole and the methyl ester thereof render improved inhibition in cooling water at temperatures of 50° C for 24 hours. As an illustration, the carboxylated benzotriazole and the methyl ester was used in concentrations as low as 250 and as high as 1000 parts per million.

TABLE 14

COPPER IN BENZENE (96 Hours at 50° C (122°F))

| Carboxy-BT Esters | Wt. Loss (mg) | % I. E. |
|---|---|---|
| None | 2.77 | — |
| Methyl | .05 | 98.2 |
| Butyl | .09 | 96.8 |
| Octyl | −.07 (2) | 100 |
| Dodecyl | −.04 (2) | 100 |

NOTES:
(1) negative sign indicates a weight gain
(2) corrosive agent was methyl disulfide
(3) results are the average of triplicate samples

TABLE 15

STEEL IN BENZENE (24 Hours at 50°C (122°F))

| Carboxy-BT Esters | Wt. Loss (mg) | % I. E. |
|---|---|---|
| None | 62.32 | — |
| Methyl | 5.41 | 91.32 |
| Butyl | 1.07 | 98.28 |
| Octyl | 23.53 | 62.24 |
| Dodecyl | 76.60 | 0 |

NOTES:
(1) corrosive agent was acetic acid
(2) results are the average of triplicate samples The data in the above tables show that when the various esters of carboxylated benzotriazole are added in concentrations of 200 parts per million of benzene, the Inhibition Efficiency was substantially improved in comparision to the blank. These tests were run for copper in corrosive benzene for 96 hours and for steel in corrosive benzene for 24 hours.

While this invention has been described by a number of specific embodiments it is obvious that other variations and modifications may be made without departing from the spirit and the scope of the invention as set forth in the appended claims.

The invention claimed is:

1. A process for inhibiting the corrosion of metals in contact with corrosive organic liquids and aqueous systems which comprises adding to the organic liquid or aqueous system a corrosion inhibiting amount of at least one carboxylated benzotriazole having the formula:

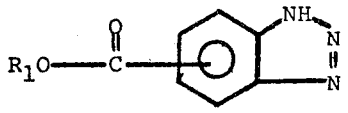

wherein $R_1$ is selected from the class consisting of hydrogen, an alkali metal and an aliphatic radical of 1 to 12 carbon atoms.

2. The process of claim 1 further characterized in that the carboxylated benzotriazole is added to an aqueous system in corrosion inhibiting amounts ranging up to about 5000 parts by weight of the benzotriazole for every million parts by weight of the aqueous system.

3. The process of claim 1 further characterized in that the carboxylated benzotriazole is added to a corrosive organic liquid in corrosive inhibiting amount ranging up to about 5000 parts by weight of the benzotriazole for every million parts by weight of the organic liquid.

4. The process of claim 2 further characterized in that the aqueous system comprises a major amount of water.

5. The process of claim 2 further characterized in that an alcohol is present in the aqueous system in an amount ranging up to about 99% by weight.

6. The process of claim 5 further characterized in that the alcohol is a lower molecular weight monohydric aliphatic alcohol.

7. The process of claim 5 further characterized in that the alcohol is a polyhydric aliphatic alcohol.

8. The process of claim 7 further characterized in that the polyhydric alcohol is ethylene glycol.

9. The process of claim 3 further characterized in that the corrosive organic liquid comprises an aliphatic organic solvent.

10. The process of claim 3 further characterized in that the corrosive organic liquid comprises an aromatic organic solvent.

11. The process of claim 1 further characterized in that the metals in contact with the corrosive organic liquid and the aqueous system are selected from the class consisting of copper, aluminum, iron and the alloys of copper, aluminum and iron.

12. The process of claim 1 further characterized in that $R_1$ is hydrogen.

13. The process of claim 1 further characterized in that $R_1$ is an alkali metal.

14. The process of claim 1 further characterized in that $R_1$ is an aliphatic radical.

15. The process of claim 1 further characterized in that the aqueous system contains the carboxylated benzotriazole in an amount ranging from about 0.01 to 5000 parts by weight of the benzotriazole for every million parts by weight of the aqueous system.

* * * * *